US008295726B2

(12) United States Patent
Kagawa et al.

(10) Patent No.: US 8,295,726 B2
(45) Date of Patent: Oct. 23, 2012

(54) FIXING DEVICE, IMAGE FORMING APPARATUS, AND METHOD FOR CONTROLLING FIXING DEVICE

(75) Inventors: Toshiaki Kagawa, Osaka (JP); Susumu Murakami, Osaka (JP); Masashi Hirai, Osaka (JP); Atsushi Ide, Osaka (JP); Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 366 days.

(21) Appl. No.: 12/629,149

(22) Filed: Dec. 2, 2009

(65) Prior Publication Data

US 2010/0142988 A1 Jun. 10, 2010

(30) Foreign Application Priority Data

Dec. 5, 2008 (JP) ..... 2008-311200

(51) Int. Cl.
*G03G 15/20* (2006.01)

(52) U.S. Cl. ..... 399/69; 399/67; 399/327

(58) Field of Classification Search ..... 399/67, 399/69, 327

See application file for complete search history.

(56) References Cited

U.S. PATENT DOCUMENTS 6,117,240 A * 9/2000 Tomono et al. ..... 118/668
6,862,416 B2 3/2005 Hashiguchi et al.
2004/0028423 A1* 2/2004 Hashiguchi et al. ..... 399/69
2007/0189817 A1 8/2007 Kagawa
2007/0264059 A1 11/2007 Maeda et al.

FOREIGN PATENT DOCUMENTS

| | | | |
|---|---|---|---|
| CN | 101071290 | A | 11/2007 |
| JP | 59-045475 | A | 3/1984 |
| JP | 09-269693 | A | 10/1997 |
| JP | 2000-330408 | A | 11/2000 |
| JP | 2003-156953 | A | 5/2003 |
| JP | 2004-013045 | A | 1/2004 |
| JP | 2004-198659 | A | 7/2004 |
| JP | 2005-164717 | A | 6/2005 |
| JP | 2007-212896 | A | 8/2007 |
| JP | 2008-170649 | A | 7/2008 |

OTHER PUBLICATIONS

English Translation of JP09-269693 to Nagai, Oct. 1997.*

* cited by examiner

*Primary Examiner* — Ryan Walsh
(74) *Attorney, Agent, or Firm* — Renner, Otto, Boisselle & Sklar, LLP

(57) ABSTRACT

In a fixing device including (i) an external heat belt which abuts against a surface of a fixing roller so as to heat the fixing roller and (ii) a cleaning member which abuts against the external heat belt, a fixing temperature, which is a surface temperature of the fixing roller during a fixing process, is set per group into which recording media to be subjected to the fixing process are divided according to their widths in a direction of a rotary axis of the fixing roller, in such a way that the fixing temperature is set to a lower temperature for a group of narrower widths. This makes it possible to prevent a reduction in releasability of the fixing roller caused by a material, which is scraped off from the external heat belt by the cleaning member and then adhered to the fixing roller, thereby preventing the high-temperature offset.

13 Claims, 5 Drawing Sheets

FIXING DEVICE, IMAGE FORMING APPARATUS, AND METHOD FOR CONTROLLING FIXING DEVICE

This Nonprovisional application claims priority under 35 U.S.C. §119(a) on Patent Application No. 2008-311200 filed in Japan on Dec. 5, 2008, the entire contents of which are hereby incorporated by reference.

TECHNICAL FIELD

The present invention relates to (i) a fixing device for use in an image forming apparatus employing an electrophotographic printing method, and (ii) an image forming apparatus including the fixing device. Further, the present invention relates to a method for controlling the fixing device.

BACKGROUND ART

A fixing device of a heat roller fixing type has been widely used in an image forming apparatus, such as a copier and a printer, employing an electrophotographic printing method. The fixing device of the heat roller fixing type generally includes a pair of rollers pressured against each other (a fixing roller and a pressure roller), and fixes a non-fixed toner image with heat and pressure by (i) heating the pair of rollers with heating means, and then (ii) feeding recording paper, on which the non-fixed toner image is formed, into a pressure area (fixing nip area) of the pair of rollers so that the recording paper passes through the pressure area. The heating means is provided inside both or one of the pair of the rollers and includes a halogen heater or the like.

Meanwhile, the fixing device provided in a color image forming apparatus generally employs an elastic roller, which is a fixing roller whose surface is covered with an elastic layer made of silicon rubber or the like. If the fixing roller is the elastic roller, then the surface of the fixing roller is elastically deformed according to an irregular surface level of the non-fixed toner image and makes contact with the non-fixed toner image with the deformed shape so that the non-fixed toner image is covered with the fixing roller that is 3-dimensionally in contact with the non-fixed toner image. This makes it possible to appropriately fix a multicolor non-fixed toner image, which holds more toner quantitatively than a black non-fixed toner image. Further, since the elastic layer deformed tries to recover its original shape in the fixing nip area, it is possible to improve releasability of the toner from the fixing roller, particularly a color toner which is more likely to offset than a black toner. Moreover, since the elastic layer of the fixing roller is deformed concavely, the fixing nip area is to have a convexed nip shape which bows upward (toward the fixing roller) in a convex curve (i.e., inverse nip shape). The inverse nip improves strippability of the recording paper from the fixing roller, thereby making the recording paper strippable without providing stripping means such as a stripping blade (i.e., self stripping is achieved). As such, it is possible to prevent an image defect which attributes to the stripping means.

However, in a case where such a fixing device provided in the color image forming apparatus operates at a high processing speed (processing speed is a speed at which the recording paper passes through the fixing nip area; i.e., fixing speed), the non-fixed toner image would not be given sufficient heat, and the non-fixed toner would not be appropriately fixed. Therefore, the fixing device cannot operate at the high processing speed without a wider nip width in the fixing nip area. Such a wider nip width will give sufficient heat to the non-fixed toner image and make it possible to appropriately fix the non-fixed toner even with the high processing speed. The nip width may be widened by (1) thickening the elastic layer of the fixing roller or (2) increasing a diameter of the fixing roller.

However, the conventional fixing roller, which includes the heating means inside thereof and whose surface is covered with the elastic layer, has the following problem. Since the elastic layer is very poor in heat conductivity, a temperature of the surface of the fixing roller does not quickly follow a temperature change of the heating means when the conventional fixing roller operates at the high processing speed. Therefore, if the elastic layer is thickened as in the configuration (1), then the temperature of the surface of the fixing roller follows more slowly the temperature change of the heating means. Further, the configuration (1) takes a long time to warm-up the fixing roller for heating, greater power consumption, because of the poor heat conductivity of the elastic layer.

Further, if the diameter of the fixing roller is increased as in the configuration (2), then a size of the fixing roller itself increases, thereby increasing a heat capacity of the fixing roller. As such, the configuration (2) takes a long time to warm up the fixing roller for the heating, and greater power consumption.

In order to solve such problems, there has been proposed fixing process employing an external heating technique, in which an external heat means is abutted against the surface of the fixing roller so as to heat the fixing roller from outside.

For example, Patent Literature 1 discloses a fixing device employing fixing process using an external belt heating technique. The fixing device includes a fixing member; an endless belt (external heat belt) suspended between a plurality of suspension rollers; and heating means for heating the endless belt. The endless belt is pressured against the fixing member so as to heat up the fixing member.

In the fixing device employing the fixing process using the external belt heating technique, the fixing roller is heated from outsize by a belt whose heat capacity is small. Therefore, the fixing roller is quickly heated, thereby shortening a time taken for warming up the fixing roller. Accordingly, it is possible to achieve a wide nip width, by providing the elastic layer of low hardness on the surface of the fixing roller or by increasing the diameter of the fixing roller while solving the problem of the temperature change of the fixing roller and the problem of the time taken for warming up the fixing roller.

However, in the technique disclosed in Patent Literature 1, a cleaning web is abutted against the surface of the fixing roller in a position upstream of the abutment of the external heat belt in a direction in which the fixing roller rotates. The cleaning web provided as such removes the toner, paper powder, or the like, which are adhered to the surface of the fixing roller, and protects the external heat belt against the toner, the paper powder, or the like. In this arrangement, since the cleaning web and the surface of the fixing roller are rubbed with each other, the rubbing would cause a scratch on the surface of the fixing roller. This scratch will lead to an image defect.

In order to solve this problem, it is an option to abut a cleaning member made of a scraper or a pad etc. against the external heat belt without providing the cleaning web which rubs with the fixing roller, thereby protecting the external heat belt and the fixing roller against the toner, the paper powder, or the like (this arrangement is not a conventional art, but the one developed by the inventors of the present invention).

Citation List

Patent Literature 1

Japanese Patent Application Publication, Tokukai, No. 2007-212896 A (Publication Date: Aug. 23, 2007)

SUMMARY OF INVENTION

Technical Problem

The inventors of the present invention studied the arrangement in which the cleaning member made of the scraper or the pad etc. is abutted against the external heat belt without providing the cleaning web which rubs with the fixing roller. As a result, the inventors of the present invention found that if a fixed cleaning member such as the scraper and the pad is abutted against the external heat belt, then the fixed cleaning member scrapes off a coating material (coating layer) from the external heat belt, and then the coating material scraped off adheres to the fixing roller. This is a cause of decrease in releasability of the fixing roller.

Particularly, it was found that in a case where large-size recording paper is subjected to a fixing process immediately after sheets of small-size recording paper are continuously subjected to the fixing process, a region of the fixing roller in which region the sheets of small-size recording paper did not abut becomes prone to a high-temperature offset due to decrease in the releasability of the fixing roller. The reason thereof is assumed as follows.

That is, in a case where the large-size recording paper is subjected to the fixing process, the coating material which is adhered to the fixing roller moves onto the recording paper. Therefore, the surface of the fixing roller is always cleaned with the recording paper, thereby keeping the releasability of the fixing roller. However, in a case where the small-size recording paper is continuously subjected to the fixing process, the coating material is accumulated in a paper non-passing region (a region, in the surface of the fixing roller, which does not make contact with the small-size recording paper), thereby reducing the releasability of the paper non-passing region compared to a paper passing region. Further, in the case where the small-size recording paper is continuously subjected to the fixing process, a temperature of the paper non-passing region becomes higher than that of the paper passing region, and then the paper non-passing region becomes prone to the high-temperature offset. In addition, since negatively charged recording paper (approximately −500V) is fed and thereby the paper passing region is to have higher negative charge than the paper non-passing region, the paper passing region strongly and electrostatically repels the toner which is negatively charged. As a result, the paper passing region is electrostatically in a state where the offset rarely occurs. In contrast, the paper non-passing region is negatively charged more weakly than the paper passing region and is subject to the offset, because the paper non-passing region is not fed with the recording paper. As such, in the case where the large-size recording paper is subjected to the fixing process immediately after the small-size recording paper was continuously subjected to the fixing process, a region of the fixing roller, which region corresponds to the paper non-passing region in which the small-size recording paper is not fed, becomes prone to the high-temperature offset.

The present invention has been made in view of the foregoing problems, and an object thereof is to prevent the high-temperature offset in the fixing device employing the external heating method, wherein the fixing device includes: an external heat member which abuts against a surface of the fixing member so as to heat a fixing member; and a cleaning member which abuts against a surface of the external heat member so as to clean the surface of the external heat member, and the high-temperature offset is caused due to decrease in the releasability of the fixing member caused by materials which were scraped off from the external heat member by the cleaning member and then adhered to the fixing member.

Solution to Problem

In order to attain the object, a fixing device of the present invention is a fixing device including: a fixing member which rotates; a pressure member which is pressed against the fixing member; an external heat member which rotatably abuts against a surface of the fixing member so as to heat the fixing member; heating means for heating the external heat member; a cleaning member which abuts against a surface of the external heat member so as to remove work-ups being adhered to the surface of the external heat member, wherein: a recording medium is fed in between the fixing member and the pressure member, and onto the recording medium, the fixing member thermally fixes a toner image on the recording medium, the fixing device including: a control section for controlling a surface temperature of the fixing member, the control section being configured such that a fixing temperature is set per group into which recording media to be subjected to the fixing process are divided according to their widths in a direction of a rotary axis of the fixing member, the fixing temperature being a surface temperature of the fixing member during a fixing process, and being set in such a way that the fixing temperature is set to a lower temperature for a group of narrower widths.

Further, in order to attain the object, a controlling method of the present invention of controlling a fixing device is a controlling method of a fixing device, the fixing device including: a fixing member which rotates; a pressure member which is pressed against the fixing member; an external heat member which rotatably abuts against a surface of the fixing member so as to heat the fixing member; heating means for heating the external heat member; a cleaning member which abuts against a surface of the external heat member so as to remove work-ups being adhered to the surface of the external heat member, wherein: a recording medium is fed in between the fixing member and the pressure member, and onto the recording medium, the fixing member thermally fixes a toner image on the recording medium, the controlling method including: setting a fixing temperature per group into which recording media to be subjected to the fixing process are divided according to their widths in a direction of a rotary axis of the fixing member, the fixing temperature being a surface temperature of the fixing member during a fixing process, and being set in such a way that the fixing temperature is set to a lower temperature for a group of narrower widths.

According to the fixing device and the controlling method, the fixing temperature (the surface temperature of the fixing member during the fixing process) is set per group into which the recording media to be subjected to the fixing process are divided according to their widths in the direction of the rotary axis of the fixing member, in such a way that the fixing temperature is set to the lower temperature for the group of the narrower widths. This makes it possible to prevent an excess heating of the fixing member in a region where the recording medium does not abut, thereby preventing a temperature rise of the external heat member in a region where the above region of the fixing member abuts. Therefore, it is possible to prevent the surface of the external heat member from being heated and becoming easily scrapable. As such, it is possible to reduce an amount of the materials scraped off from the external heat member due to a rubbing contact of the external heat member and the cleaning member, thereby reducing an amount of the materials adhered to the fixing member. As a result, it is possible to prevent a decrease in releasability of the fixing member caused by the materials adhered to the fixing member, and to prevent the high-temperature offset in a region where the materials adhere.

Advantageous Effects of Invention

As described above, in the fixing device and the controlling method of the fixing device, the fixing temperature (the surface temperature of the fixing member during the fixing process) is set per group into which the recording media to be processed are divided according to their widths in the direction of the rotary axis of the fixing member, in such a way that the fixing temperature is set to the lower temperature for the group of the narrower widths.

Therefore, the amount of the materials scraped off from the external heat member due to the rubbing contact of the external heat member and the cleaning member can be reduced, and therefore it is possible to prevent the decrease in releasability of the fixing member caused by the materials adhered to the fixing material, and to prevent the high-temperature offset in the region where the materials adhere.

BRIEF DESCRIPTION OF DRAWINGS

FIG. 2 is a cross-sectional view illustrating an image forming apparatus employing the fixing device of FIG. 1.

FIG. 3 shows an elevation view and a side view illustrating a scraper provided in the fixing device of FIG. 1.

FIG. 4 is a cross-sectional view illustrating an external heat unit provided in the fixing device of FIG. 1.

FIG. 5 is a diagram illustrating an enlarged main part of an abutting section of an external heat belt and the scraper, which are provided in the external heat unit included in the fixing device of FIG. 1.

FIG. 6 is a flow diagram describing a control method of the fixing device illustrated in FIG. 1.

DESCRIPTION OF EMBODIMENTS

One embodiment of the present invention is described as follows. The present embodiment describes the present invention, referring to an example where the present invention is employed in an image forming apparatus of a color tandem type, which forms a multicolor or unicolor image on a recording medium such as a recording paper and a recording film according to an image data transmitted from outside. Note however that the present invention is applicable not only in such an image forming apparatus of a color tandem type, but also in other image forming apparatus, provided that the image forming apparatus includes a fixing device employing an external heating technique, the fixing device including: an external heat member which abuts against a surface of the fixing member so as to heat a fixing member; and a cleaning member which abuts against a surface of the external heat member so as to clean the surface of the external heat member.

<Configuration of Image Forming Apparatus>

Figure 2:
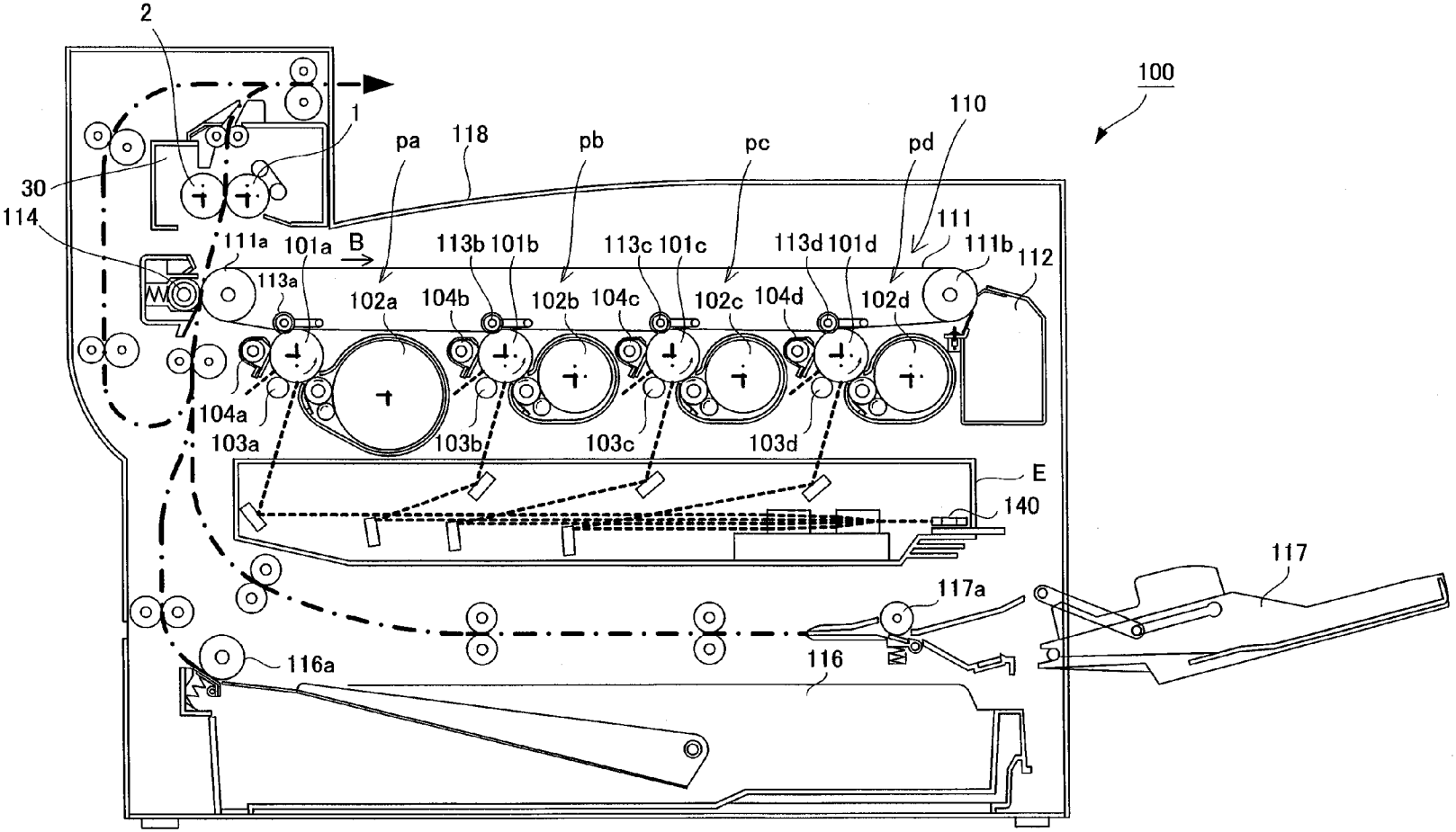
FIG. 2

FIG. 2 is a cross-sectional view schematically illustrating a configuration of an image forming apparatus 100 according to the present embodiment.

As illustrated in FIG. 2, the image forming apparatus 100 includes: an exposure unit (optical system unit) E; four pairs of visible image forming units pa to pb; an intermediate transfer belt unit 110; a second transfer unit 114; a fixing device 30; an internal paper feeding unit 116; and a manual paper feeding unit 117. Note that operations of these members included in the image forming apparatus 100 are controlled by a main control section constituted by CPU (not illustrated) or the like.

The image forming apparatus 100 deals with image data corresponding to a color image formed from black (K), cyan (C), magenta (M), and yellow (Y). For this purpose, the image forming apparatus 100 includes four sets of visible image forming units pa to pb, which respectively form toner images of respective colors that will be superimposed with each other on an intermediate transfer belt 111 (see FIG. 2).

The visible image forming unit pa includes: a photoreceptor 101*a*; a charging unit 103*a*; a developing unit 102*a*; and a cleaning unit 104*a*. The photoreceptor 101*a* is rotatable and serves as a toner image carrying member. Around the photoreceptor 101*a*, the charging unit 103*a*, the developing unit 102*a*, and the cleaning unit 104*a* are arranged in this order along a direction in which the photoreceptor 101*a* rotates.

The charging unit 103*a* uniformly charges a surface of the photoreceptor 101*a* to a predetermined electrical potential. The charging unit 103*a* of the present embodiment employs a charging roller technique (contact charging technique) so that generation of ozone can be avoided as much as possible in uniformly charging the surface of the photoreceptor 101*a*. However, the charging unit 103*a* is not limited to those employing the charging roller method, and may be, for example, a non contact-type charging device employing a corona discharge method. Alternatively, the charging unit 103*a* may be a contact-type charging device, which employs brush charging or the like.

The developing unit 102*a* performs a developing process. By the developing process an electrostatic latent image formed on the photoreceptor 101*a* is visualized. The toner may be, for example, a nonmagnetic one-component developer (nonmagnetic toner), a nonmagnetic two-component developer (nonmagnetic toner and carrier), or a magnetic developer (magnetic toner).

The cleaning unit 104*a* is configured to remove and collect a toner remaining on the surface of the photoreceptor 101*a*, after the toner images are transferred to the intermediate transfer belt 111.

The visible image forming units pb to pd are configured substantially identically with the visible image forming unit pa, except that the visible image forming units pb to pd respectively deals with colors different from that of visible image forming unit pa. That is, the visible image forming units pa, pb, pc, and pd contain toners of black (B), yellow (Y), magenta (M), and cyan (C), respectively.

The exposure unit E exposes the photoreceptors 101*a* to 101*d* which are charged by the charging units 103*a* to 103*d* respectively in accordance with the image data, thereby forming the electrostatic latent images corresponding to the image data on surfaces of the respective photoreceptors 101*a* to 101*d*. The exposure unit E employs a laser scanning unit (LSU) including a laser irradiation section 104 and reflection mirrors 141. The exposure unit E may be, for example, an EL or LED writing head in which light-emitting elements are arranged in an array-shape.

The intermediate belt unit 110 includes: the intermediate transfer belt 111; an intermediate transfer belt driving roller (tension roller) 111*a*; an intermediate transfer belt-driven roller (tension roller) 111*b*; an intermediate transfer belt cleaning unit 112; and intermediate transfer rollers 113*a* to 113*d*.

The intermediate transfer belt 111 is an endless belt made of a film of approximately 100 μm to 150 μm in thickness. The intermediate transfer belt 111 is suspended with tension by the intermediate transfer belt driving roller 111*a*, the intermediate transfer belt-driven roller 111*b*, and the intermediate transfer rollers 113*a* to 113*d*. The intermediate transfer belt 111 rotates in a direction indicated by the arrow B in FIG. 2. The toner images of respective colors formed on the respective photoreceptors 101*a* to 101*d* are sequentially transferred to the intermediate transfer belt 111 so that they are superimposed with each other, thereby forming a colored toner image (multicolor toner image) on the intermediate transfer belt 111. The intermediate transfer rollers 113*a* to 113*d* are provided for photoreceptors 101*a* to 101*d* respectively in such a manner that the intermediate rollers 113*a* to 113*d* respectively face the photoreceptors 101*a* to 101*d* via the intermediate transfer belt 111 at positions between where the developing units 102*a* to 102*b* face the photoreceptors 101*a* to 101*d* and where the cleaning units 104*a* to 104*d* face the photoreceptors 101*a* to 101*d*. The toner images on the respective photoreceptors 101*a* to 101*d* are transferred to the intermediate transfer belt 111 by high voltage application to the intermediate transfer rollers 113*a* to 113*d*. The high voltage applied to the intermediate transfer rollers 113*a* to 113*d* is positive (+) in polarity, on the contrary that the toner is negatively (−) charged. The multicolor toner image formed on the intermediate transfer belt 111 is carried to an area in which the intermediate transfer belt driving roller 111*a* and the second transfer unit 114 face each other, where the multicolor toner image is transferred to recording paper which has been carried to this area. The intermediate transfer belt cleaning unit 112 abuts against the intermediate transfer belt 111 so as to remove and collect the toner remaining on the intermediate transfer belt 111 after the multicolor toner image is transferred to the recording paper.

The fixing device 30 includes: a fixing roller (fixing member) 1; and a pressure roller (pressure member) 2 which is pressured against the fixing roller 1 at a predetermined load by pressure auxiliary means (not illustrated). The recording paper on which the multicolor toner image is transferred by the second transfer unit 114 is fed into a pressure area (fixing nip area) of the fixing roller 1 and the pressure roller 2 so that the recording paper passes through the pressure area, thereby fixing the multicolor toner image with heat and pressure. The recording paper passes through the pressure area in such a way that a surface on which a non-fixed multicolor toner image is formed abuts on the fixing roller 1 and the other surface abuts on the pressure roller 2. The fixing device 30 is more specifically described later.

The internal paper feeding unit 116 is a container which contains recording paper (recording media) on each of which an image is to be formed. The manual paper feeding unit 117 is provided foldably on a side wall of the image forming apparatus 100, and is for manual feeding of the recording paper. A paper output tray 118 is a tray for the recording paper on which the image has been formed.

The image forming apparatus 100 further includes paper carrying paths through which the recording paper fed by a pickup roller 116*a* from the internal paper feeding unit 116 and fed by a pickup roller 117*a* from the manual paper feeding unit 117 are carried, via the second transfer unit 114 and the fixing device 30, to the paper output tray 118. The paper carrying paths are provided with a number of rollers which carry the recording paper.

Note that the image forming apparatus of the present embodiment supports recording papers ranging from those of a letter size to those of A4 size. That is, the image forming apparatus of the present embodiment is what is called an A4 machine, which also supports recording papers of A5 size and an invoice size that are smaller than those of A4 size.

<Fixing Device>

Figure 1:
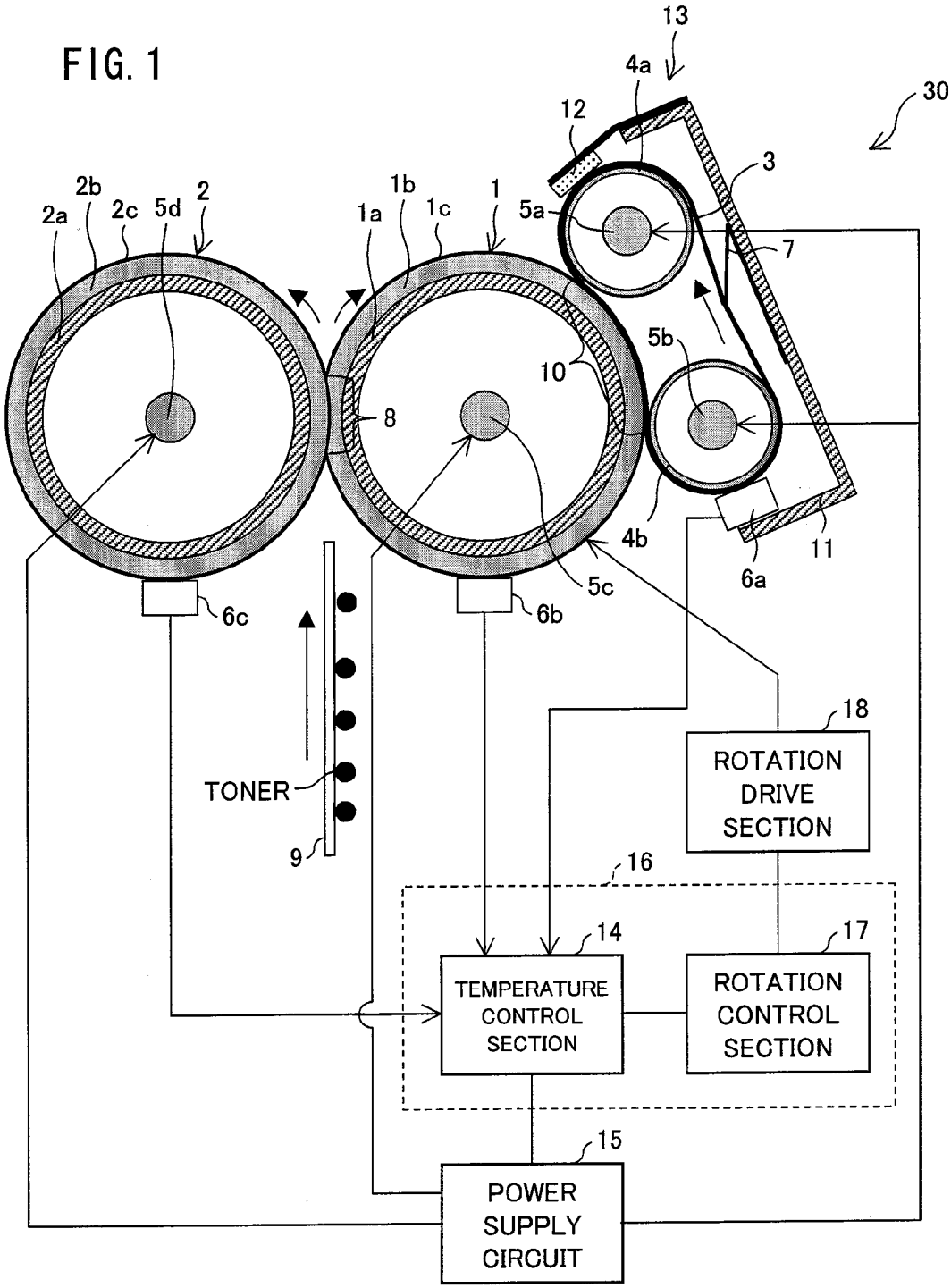
FIG. 1 is a schematic view illustrating a configuration of a fixing device according to one embodiment of the present invention.

FIG. 1 is a cross-sectional view illustrating a configuration of a fixing device 30. As illustrated in FIG. 1, the fixing device 30 includes: a fixing roller (fixing member) 1; a pressure roller (pressure member) 2; an external heat unit 13; a power supply circuit 15; a control section 16; and a rotation drive section 18. The power supply circuit 15 supplies power to heater lamps 5*a* to 5*d*, which are described later.

The fixing roller 1 is a roller which is heated to a predetermined fixing temperature and is driven by the rotation drive section 18 to rotate in a direction indicated by the arrow shown in FIG. 1. The fixing roller 1 has a three-layered structure, which includes: a cored bar 1*a* which is in a shape of hollow cylinder and made of metal; an elastic layer 1*b* which covers an outer surface of the cored bar 1*a*; and a releasing layer 1*c* which covers the elastic layer 1*b*. The rotation drive section 18 rotates the fixing roller 1, and includes a motor, gear, and the like (not illustrated). Note that in the present embodiment, speed at which a surface of the fixing roller 1 moves, i.e., fixing speed (processing speed), is set to 225 mm/sec. The fixing roller 1 designed as such makes it possible to form images at copying speed (printing speed) of 40 sheets/min.

The cored bar 1*a* is made of aluminum of 2 mm in thickness, and is in a shape of cylinder. The cored bar 1*a* is not limited to aluminum, and may be made of for example iron, stainless steel, or the like. The elastic layer 1*b* is made of heat-resistant silicon rubber of 2.5 mm in thickness. The elastic layer 1*b* is not limited to silicon rubber, and may be made of for example fluorine rubber. The releasing layer 1*c* is made of a non-conducting PFA (copolymer of tetrafluoroethylene and perfluoroalkyl vinyl ether) tube of 40 μm in thickness. The releasing layer 1*c* may be made of any material having excellent heat resistance, excellent durability, and excellent toner releasability. Apart from the PFA, the releasing layer 1*c* may be made of a fluorinated material, such as PTFE (polytetrafluoroethylene). The fixing roller 1 structured as such is 40 mm in an external diameter.

On the outer surface of the fixing roller 1, a thermistor (temperature detecting section) 6*b* which detects a temperature of the outer surface is provided. Inside the fixing roller 1, a heater lamp 5*c* is provided. The heater lamp 5*c* radiates heat when power is supplied thereto. The heater lamp 5*c* serves as a heat source of the fixing roller 1. The power supplied to the heater lamp 5*c* from the power supply circuit 15 is under control of a temperature control section 14 provided to the control section 16. In this way, the heater lamp 5*c* emits infrared ray. The infrared ray emitted by the heater lamp 5*c* is absorbed into an inside surface of the fixing roller 1 and heats the inside surface of the fixing roller 1, so that an entire fixing roller 1 is heated. The thermistor 6*b* is provided so as to detect a temperature of the fixing roller 1 at its central part in a rotary axis direction thereof (width direction of the fixing roller 1). In the present embodiment, recording paper is fed to the fixing roller 1 in such a way that a substantially central part of the recording paper in a direction perpendicular to a direction in which the recording paper is fed abuts on a central part of the fixing roller 1 in the rotary axis direction, regardless of a size of the recording paper. Therefore, the thermistor 6*b* is provided so as to detect a surface temperature of the fixing roller 1 in a position through which the recording paper always passes regardless of its size. Note that in the present embodiment, the fixing temperature is a temperature detected by the thermistor 6*b* during a fixing process.

The pressure roller 2, which is rotated by the rotation of the fixing roller 1, is pressed against the fixing roller 1 at a predetermined load (in the present embodiment, the predetermined load is 360 N) by pressure auxiliary means such as a spring (not illustrated) so that a fixing nip area 8 is formed between the fixing roller 1 and the pressure roller 2. Fixing nip width (width of the fixing nip area 8 in the direction in which a recording paper 9 is carried) is 8 mm in the present embodiment. Similarly to the fixing roller 1, the pressure roller 2 has a three layer structure including: a cored bar 2*a* which is in the shape of hollow cylinder and is made of metal; an elastic layer 2*b* which covers an outer surface of the cored bar 2*a*; and a releasing layer 2*c* which covers the elastic layer 2*b*.

In the present embodiment, the pressure roller 2 is structured in the same manner as the fixing roller 1; that is, the pressure roller is made by forming the elastic layer 2*b* made of silicon rubber of 2.5 mm in thickness on the cored bar 2*a* made of aluminum of 2 mm in thickness, and further forming the releasing layer 2*c* made of a nonconductive PFA tube of 40 μm in thickness on the elastic layer 2*b*. Note however that the structure of the pressure roller is not limited to this structure, and for example, the cored bar 2*a* may be made of iron or stainless steel, the elastic layer 2*b* may be made of fluorine rubber, and the releasing layer 2*c* may be made of a fluorinated material such as PTFE. The present embodiment employs the pressure roller 2 of the same shape and the same material as the fixing roller 1; however, the pressure roller 2 is not limited to that of the same shape and the same material as the fixing roller 1. For example, the pressure roller 2 may have higher hardness than the fixing roller 1. In such a case, it is possible to achieve the fixing nip area, which is formed between the pressure roller 2 and the fixing roller 1, of an inverse nip shape (i.e., fixing roller 1 is slightly concaved whereas the pressure roller 2 remains in substantially the same shape), thereby improving a self-detachability of the recording paper from the fixing roller 1 when the recording paper is outputted from the fixing nip area.

On an outer surface of the pressure roller 2, a thermistor 6*c* is provided to detect a temperature of the outer surface. Inside the pressure roller 2, a heater lamp 5*d* is provided. The thermistor 6*c* is provided in a central part, in a rotary axis direction (width direction), of the pressure roller 2, in the same manner as the thermistor 6*b* of the fixing roller 1. The heater lamp 5*d* radiates heat when power is supplied thereto. The heater lamp 5*d* serves as a heat source of the pressure roller 2. The power supplied to the heater lamp 5*d* from the power supply circuit 15 is under control of the temperature control section 14. In this way, the heater lamp 5*d* emits infrared ray. The infrared ray emitted by the heater lamp 5*d* heats an inside surface of the pressure roller 2.

The external heat unit 13 heats the outer surface of the fixing roller 1, and includes: heat rollers 4*a* and 4*b*; an external heat belt (endless belt) 3; heater lamps (heating sections) 5*a* and 5*b*; a thermistor 6*a*; a scraper (cleaning member) 7; a cleaning pad (cleaning member) 12; and an external heat unit holder (housing) 11 which houses these members.

The heat rollers 4*a* and 4*b* are hollow cylindrical core materials, each of which is 16 mm in diameter and is made of aluminum of 2 mm in thickness. Materials of the heat rollers 4*a* and 4*b* are not limited to aluminum, and may be metallic core materials such as iron and stainless steel. Further, a size of each of the heat rollers 4*a* and 4*b* is not limited to the size described above, and may be changed as appropriate.

The external heat belt 3 is an endless belt suspended between the heat rollers 4*a* and 4*b*. A structure of the external heat belt 3 is specifically described later.

The external heat belt 3 is provided so that the external heat belt 3 is pressured against a surface (outer surface) of the fixing roller 1 in a part downstream of the fixing nip area and upstream of the thermistor 6*a* in a rotation direction of the fixing roller 1. Here, the external heat belt 3 is pressured against the fixing roller 1 at a predetermined load (the predetermined load is 40 N in the present embodiment) by pressure auxiliary means such as a spring (not illustrated). This provides a heat nip area (in which the fixing roller 1 and the external heat belt 2 are pressured against each other) 10 between the fixing roller 1 and the external heat belt 3. Further, the external heat belt 3 is rotated by the rotation of the fixing roller 1, whereas the heat rollers 4*a* and 4*b* are rotated by the external heat belt 3. A heat nip width (a width of the heat nip area 10 in a rotary axis direction of the fixing roller 1) of the heat nip area 10 may be set as appropriate so that the external heat belt 3 appropriately heats the fixing roller 1 as well as the external heat belt 3 is appropriately rotated by the rotation of the fixing roller 1. In the present embodiment, the heat nip width is 20 mm.

The heater lamp 5*a* serves as a heat source which is provided inside the heat roller 4*a* and which heats the heat roller 4*a* from inside, whereas the heater lamp 5*b* serves as a heat source which is provided inside the heat roller 4*b* and which heats the heat roller 4*b* from inside. The heater lamps 5*a* and 5*b* emit infrared ray in such a manner that the temperature control section 14 controls the power supplied from the power supply circuit 15 to the heater lamps 5*a* and 5*b*, and the infrared ray emitted by the heater lamps 5*a* and 5*b* heats inside surfaces of the heat rollers 4*a* and 4*b*. Then, the heat rollers 4*a* and 4*b* heat the external heat belt 3 to a predetermined temperature, and then the external heat belt 3 heats the outer surface of the fixing roller 1 in such a manner that the external heat belt 3 heated to the predetermined temperature is pressured against the outer surface of the fixing roller 1. In a case where the fixing temperature is for example 190° C., the external heat belt 3 is heated to 220° C.

The thermistor 6*a* is for detecting a surface temperature of the external heat belt 3. The thermistor 6*a* is provided to detect a temperature of the external heat belt 3 at a central part of the external heat belt 3 in a rotary axis direction (width direction).

The scraper 7 removes work-ups such as toner, paper powder, and the like, which are moved onto from the fixing roller 1 to the external heat belt 3. Thereby, the scraper 7 cleans the outer surface of the external heat belt 3. The cleaning pad 12 collects the toner and the paper powder which had not been removed by the scraper 7.

That is, as illustrated in FIG. 1, the fixing roller 1 fixes a non-fixed multicolor toner image onto a surface of the recording paper 9 by abutting against the surface of the recording paper 9 on which surface the non-fixed multicolor toner image is formed. The abutment also causes the work-ups such as the toner and the paper powder to adhere to the fixing roller 1. Then, the work-ups such as the toner and the paper powder which are adhered to the fixing roller 1 are moved onto the external heat belt 3 at an abutting section of the fixing roller 1 and the external heat belt 3. The scraper 7 is for scraping and removing such work-ups such as the toner and the paper powder which are adhered to the external heat belt 3.

In a case where some of the work-ups such as the toner and the paper powder which are adhered to the external heat belt 3 had not been removed by the scraper 7, the toner and the paper powder would remain in a form of streak on the external heat belt 3 along a rotation direction of the external heat belt 3, and would damage the outer surface of the fixing roller 1 when they make contact with the fixing roller 1. If such a toner and the paper powder in the form of streak adhere to the outer surface of the external heat belt 3, then a scratch in a form of streak (image defect) appears on an image fixed on the recording paper 9. Such an image defect in the form of streak is visible particularly when printing on thick paper. The cleaning pad 12 is for collecting the some of the work-ups such as the toner and the paper powder which had not been removed by the scraper 7 so as to prevent the image defect in the linear shape.

The control section 16 includes the temperature control section 14 and a rotation control section 17. The temperature control section 14 controls the power that is supplied from the power supply circuit 15 to the heater lamps 5*a* to 5*d* based on temperatures detected by the thermistors 6*a* to 6*c*, a size of the recording paper, and the like, and thereby the temperatures of the external heat belt 3, the fixing roller 1, and the pressure roller 2 are brought to respective predetermined temperatures substantially, or they are kept at the respective predetermined temperatures. The rotation control section 17 controls an operation of the rotation drive section 18, which rotates the fixing roller 1. The control section 16 may be provided in a main control section of the image forming apparatus 100, and may also be provided separately from the main control section of the image forming apparatus 100 and operate in cooperation with the main control section.

As described above, the fixing device 30 is arranged such that the recording paper on which the non-fixed multicolor toner image is formed is fed to pass through between the fixing roller 1 and the pressure roller 2 which are pressured against each other at a predetermined load and each of which is heated to a predetermined temperature so that the non-fixed multicolor toner image is fixed on the recording paper 9.

In the present embodiment, both the fixing roller 1 and the pressure roller 2 include the heater lamp serving as heating means inside thereof; however, structures of the fixing roller 1 and the pressure roller 2 are not limited to this structure. For example, either the fixing roller 1 or the pressure roller 2 may be provided with the heater lamp, and also neither the fixing roller 1 nor the pressure roller 2 may be provided with the heater lamp.

In the present embodiment, the external heat belt 3 is suspended between the two heat rollers 4*a* and 4*b*. However, the present invention is not limited to this structure, and the external heat belt 3 may also be suspended between three or more rollers.

Further, the present embodiment employs the pressure roller 2 as a pressure member which pressures the fixing roller 1. However, the pressure member is not limited to this structure, and may be a pressure member in a form of belt.

<Details of Scraper>

Figure 3:
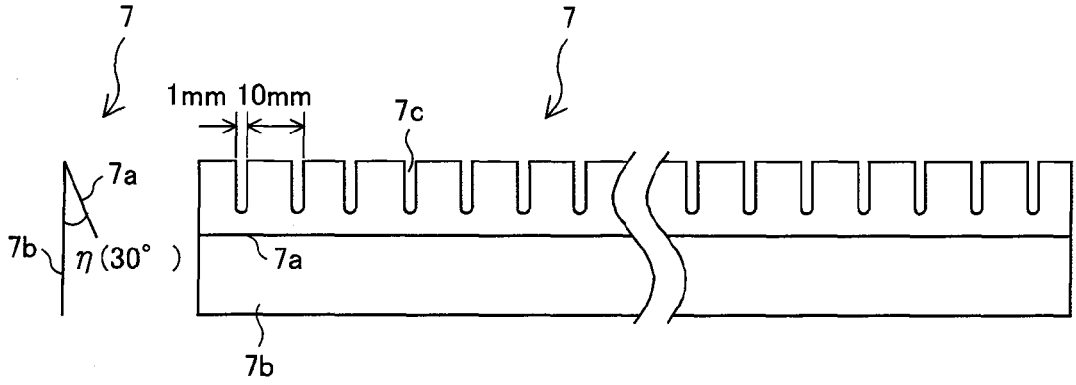
FIG. 3

FIG. 3 shows an elevation view and a side view illustrating a scraper 7. The scraper 7 is made of stainless steel of 0.3 mm in thickness, and is in a letter V shape consisting of a holding part 7*b* and a cleaning part (scraper part) 7*a* that is made by folding an edge portion of the holding part 7*b* at a sharp angle (at $\eta°$; $\eta=30°$ in the present embodiment). Further, in a region including a folded part of the holding part 7*b* and the cleaning part 7*a*, a plurality of slits (openings) 7*c* (which are provided in a direction intersecting with a straight line at which the scraper 7 is folded) are provided at a predetermined interval along a width direction of an external heat belt 3 (see FIG. 3). In the present embodiment, the slits 7*c*, which are provided along a direction substantially perpendicular to the straight line at which the scraper 7 is folded and each of which has a width of 1 mm, are provided at an interval of 10 mm.

Figure 4:
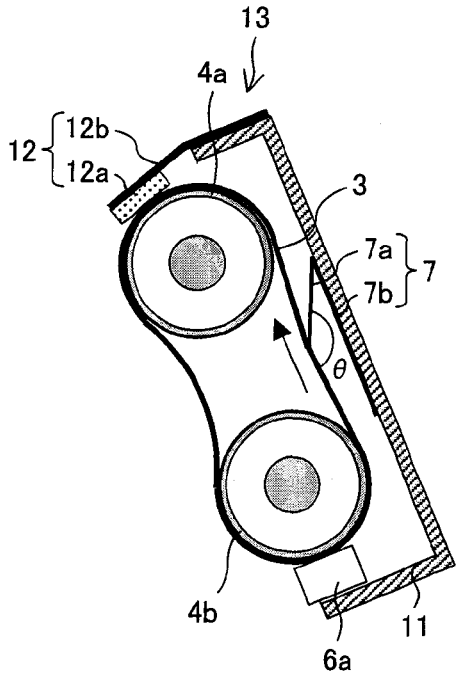
FIG. 4

FIG. 4 is a cross-sectional view illustrating an external heat unit 13. As illustrated in FIG. 4, the holding part 7*b* of the scraper 7 is fixed to an inner surface of an external heat unit holder 11 so that an edge of the cleaning part 7*a* of the scraper 7 abuts on the external heat belt 3. The edge of the cleaning part 7*a* abuts on an outer surface of the external heat belt 3 which is suspended with tension between the two heat rollers 4*a* and 4*b* a position in which an inner surface of the external heat belt 3 is in contact with neither the heat roller 4*a* nor the heat roller 4*b*. Further, the edge (edge portion) of the cleaning part 7*a* abuts on the external heat belt 3 so that the edge faces against a rotation direction of the external heat belt 3. That is, the edge of the cleaning part 7*a* abuts on the external heat belt 3 so that an abutting angle $\theta$ is 90° or larger. The abutting angle is an angle between (i) an outer surface of the external heat belt 3 located upstream of the abutting section of the scraper 7 and the external heat belt 3 in the rotation direction of the external heat belt 3, and (ii) a surface of the scraper 7 facing the outer surface of the external heat belt 3 located upstream of the abutting section of the scraper 7 and the external heat belt 3 in the rotation direction of the external heat belt 3. In the present embodiment, the edge of the cleaning part 7 abuts on the external heat belt 3 so that $\theta=150°$.

Figure 5:
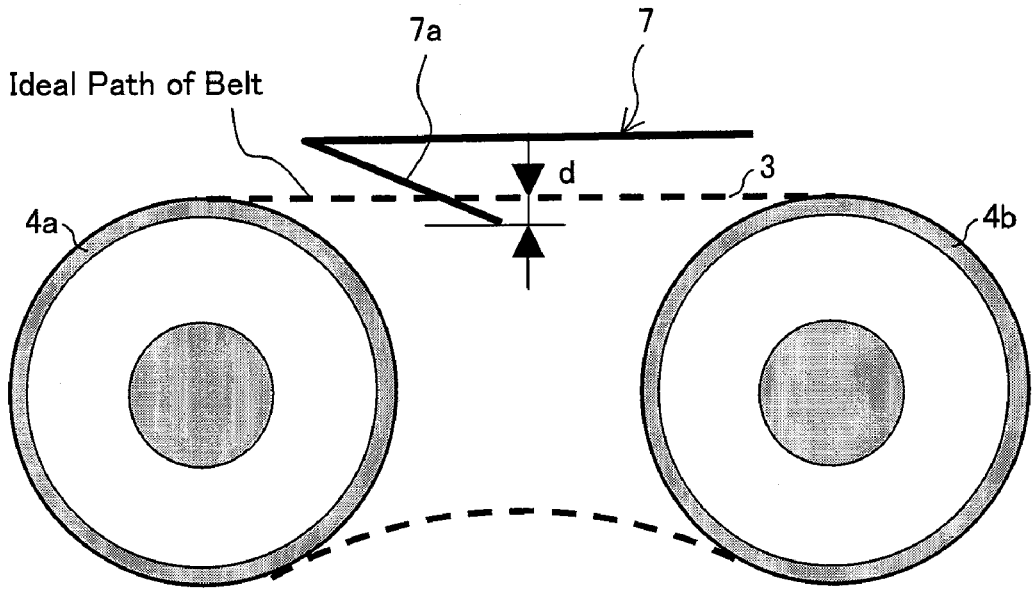
FIG. 5

FIG. 5 is a diagram illustrating an enlarged main part of the abutting section of the external heating belt 3 and the scraper 7 of the external heating unit 13. As illustrated in FIG. 5, a shape and position of the scraper 7 are set such that the edge of the cleaning part 7*a* of the scraper 7 is pressed against the external heat belt 3 so that the external heat belt 3 deviates from its ideal path (i.e., a common tangent of the external heat rollers 4*a* and 4*b*, which are positioned downstream and upstream of an abutting section of the scraper 7 and the external heat belt 3 in a rotation direction of the external heat belt 3, respectively) by a predetermined pressing amount d (d=0.6 mm in the present embodiment).

In the present embodiment, as illustrated in FIG. 4, the scraper 7 for cleaning the surface of the external heat belt 3 abuts against the outer surface of the external belt 3 in the position where the inner surface of the external belt 3 is in contact with neither the heat roller 4*a* nor the heat roller 4*b*.

This makes it possible to reduce a sliding load to be generated between a cleaning member and an external heat belt, unlike a conventional structure in which the cleaning member abuts against the external heat belt in a position where the external heat belt is in contact with a suspension roller. As a result, it is possible to prevent scratches from appearing on the external heat belt due to a sliding contact of the cleaning member with the external heat belt, and to prevent the external heat belt from slipping due to a large stress along a direction against the rotation direction of the external heat belt.

<Details of Cleaning Pad>

As illustrated in FIG. 4, a cleaning pad 12 is structured such that a felt member (cleaning member) 12*a* for cleaning is bonded to a felt holding part 12*b*. In the present embodiment, the felt member 12*a* is a felt made from fluorocarbon resin fabric of PTFE (polytetrafluoroethylene). The felt holding part 12*b* is a plate made of stainless steel of 0.2 mm in thickness, and is fixed to the external heat unit holder 11 in such a manner that the felt member 12*a* is pressured against the outer surface of the external heat belt 3.

<Details of External Heat Belt>

In the present embodiment, the external heat belt 3 is an endless belt of 90 μm in thickness and is 31.5 mm in diameter when it is in a circle, and is formed from a belt material made of polyimide. On the outer surface of the external heat belt 3, a coating layer made of a nonconductive PTFE coating (coating material) of 20 μm in thickness is provided so as to increase a toner releasability. However, a structure of the external heat belt 3 is not limited to this structure. For example, the coating layer may be made of a conductive coating material containing carbon or the like. Further, the belt material made of polyimide may be substituted by another heat-resistant resin, or by a hollow cylindrical (endless) belt material made of metallic material such as stainless steel and nickel.

Furthermore, an inner surface of the belt material may be coated with the PTFE or the like, in order to reduce slipping force (which acts on the external heat belt 3 so that the external heat belt 3 moves along a rotary axis direction (width direction) of the external heat belt 3 during rotation of the external heat belt 3).

<Result of Experiment>

Next, the following describes a result of an experiment carried out to study a relation among a fixing temperature during a fixing process of a small-size paper, a cooling period after the small-size paper has been subjected to the fixing process, and an offset.

The experiment was carried out as follows. First, 100 sheets of small-size paper (invoice size paper, 215.9 mm×139.7 mm) were continuously fed into the image forming apparatus 100 in a short edge feed orientation (width of the small-size paper in a direction perpendicular to a direction in which the small-size paper is carried: 139.7 mm) so as to form images on the small-size paper. Next, the image forming apparatus 100 was switched over to the cooling mode and cooled down for a predetermined period. Then, 5 sheets of normal-size paper (letter size paper, 279.4 mm×215.9 mm) were continuously fed into the image forming apparatus 100 in the short edge feed orientation (width of the normal size paper in a direction perpendicular to a direction in which the normal size paper is carried: 215.9 mm) so as to form images on the normal-size paper, and thereafter, the normal-size paper was checked with eyes for whether the offset occurred in a region corresponding to a paper non-passing region through which the small-size paper did not pass. This was performed under a plurality of conditions where a fixing temperature and a condition of a cooling mode were varied.

Table 1 shows fixing temperatures, conditions of the cooling period, and evaluation results of the offset. In Table 1, "YES" denotes a state where the offset was practically not a problem, whereas "NO" denotes a state where a significant level of offset occurred.

TABLE 1

| | Fixing Temperature | | | |
|---|---|---|---|---|
| | Normal-Size Paper | Small-Size Paper | Cooling Period | Toner Offset |
| Comparative Example 1 | 190° C. | 190° C. | 0 sec. | NO |
| Example 1 | 190° C. | 180° C. | 0 sec. | YES |
| Example 2 | 190° C. | 190° C. | 120 sec. | YES |

Comparative Example 1 was carried out under a condition where the fixing temperature for the normal-size paper was 190° C., the fixing temperature for the small-size paper was 190° C., and the cooling period was 0 seconds. In Comparative Example 1, considerable level of offset occurred on the letter size paper in the region corresponding to the paper non-passing region through which the invoice size paper did not pass.

Example 1 was carried out under a condition where the fixing temperature for the normal-size paper was 190° C., the fixing temperature for the small-size paper was 180° C., and the cooling period was 0 seconds. In such a case where the fixing temperature for the small-size paper (180° C.) was lower than the fixing temperature for the normal-size paper (190° C.), the offset was prevented.

The reason thereof is assumed as follows. That is, a coating material which coats the external heat belt 3 is made of fluorocarbon resin (PTFE), which becomes softer and more easily scrapable as a temperature rises. In a case where the fixing temperature is 190° C., a temperature of the external heat belt 3 in a paper non-passing region becomes 240° C. to 245° C. when the small-size paper is being subjected to the fixing process. As a result, the coating material of the external heat belt 3 in the paper non-passing region becomes very easily scrapable. On the other hand, if the fixing temperature was reduced to 180° C., then the temperature of the external heat belt 3 in the paper non-passing region can be reduced to 230° C. to 235° C. As a result, the coating material becomes rarely scrapable. Accordingly, it is possible to reduce an amount of the coating material which is adhered to the fixing roller 1, thereby preventing decrease in releasability of the fixing roller 1 and improving a level of the offset.

Example 2 was carried out under a condition where the fixing temperature for the normal-size paper was 190° C., the fixing temperature for the small-size paper was 190° C., and the cooling period was 120 seconds. In such a case where the normal-size paper was subjected to the fixing process after 100 sheets of the small-size paper was continuously subjected to the fixing process and thereafter a cooling mode operation was carried out for 120 seconds, it was possible to reduce the level of the offset so that the offset was not practically a problem.

The reason thereof is assumed as follows. That is, a high-temperature offset threshold temperature, which is a highest temperature at which the toner on the surface of the fixing roller does not offset, is generally around 215° C. when the coating material scraped off from the external heat belt is not adhered to the surface of the fixing roller. However, when the coating material is adhered to the surface of the fixing roller, the high-temperature offset threshold temperature decreases to around 200° C., because releasability of the fixing roller decreases. Meanwhile, immediately after the small-size paper was continuously subjected to the fixing process, a surface temperature of the fixing roller in a paper non-passing region is 205° C. to 210° C., which is higher than the high-temperature offset threshold temperature (200° C.). Therefore, if the normal-size paper was subjected to the fixing process immediately after the small-size paper was subjected to the fixing process without providing the cooling period, then the high-temperature offset occurs in the region corresponding to the paper non-passing region through which the small-size paper did not pass. However, in Example 2, the surface temperature of the fixing roller in the paper non-passing region is reduced to 190° C., because 120 seconds of the cooling period was provided after the small-size paper was continuously subjected to the fixing process. Accordingly, it is possible to reduce the surface temperature of the fixing roller to the high-temperature offset threshold temperature (200° C.) of a case where the coating material is adhered to the surface of the fixing roller, or to a temperature lower than 200° C., thereby preventing the offset.

<Details of Temperature Control Method by Control Section 16>

Figure 6:
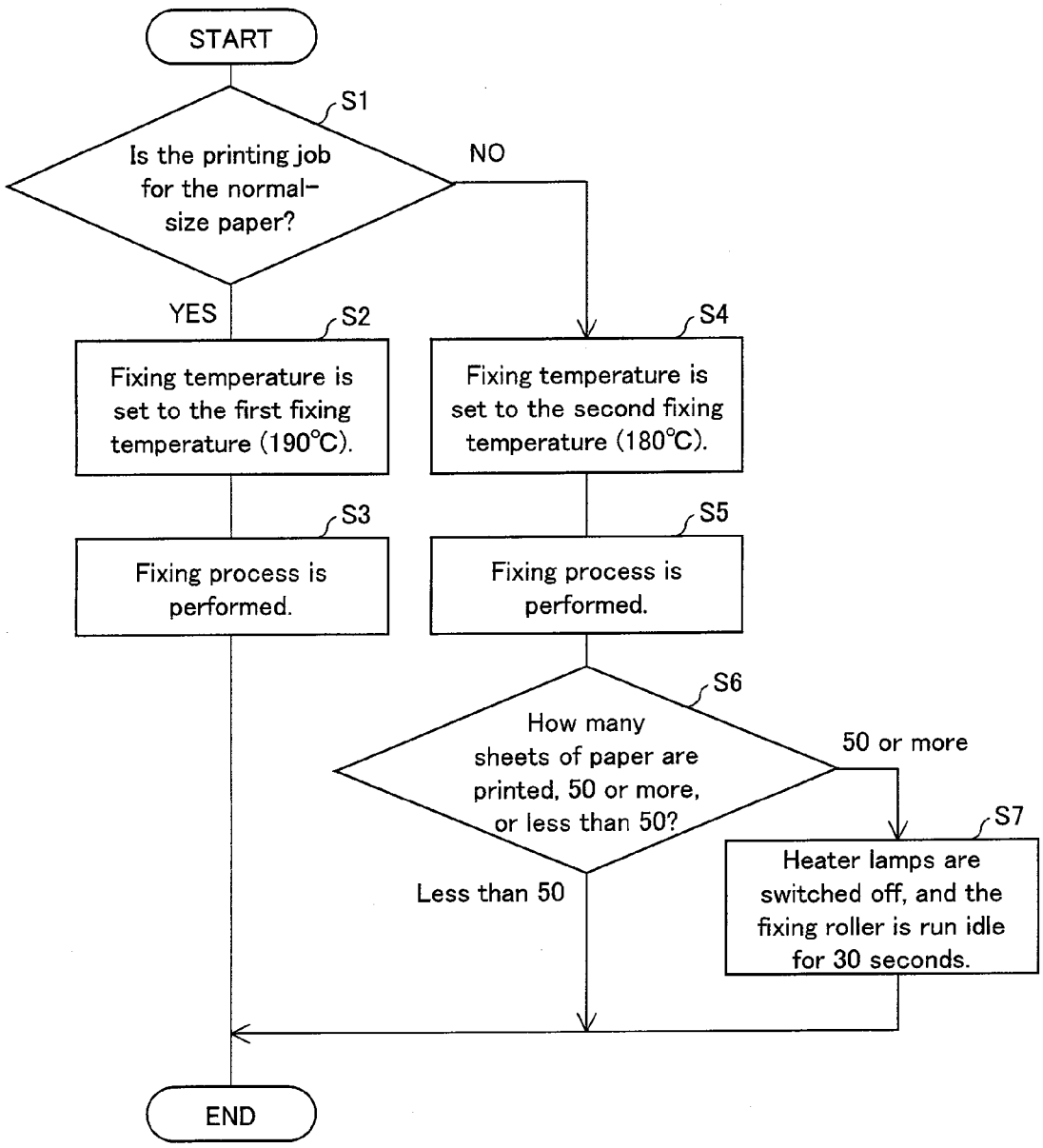
FIG. 6

FIG. 6 is a flow diagram describing a flow of a temperature control process performed by a control section 16.

Upon reception of an image forming job, the control section 16 determines whether the image forming job is for normal-size paper or for small-size paper, prior to image formation (S1). The normal-size paper here means recording paper having a width substantially equal to a maximum width of recording paper that an image forming apparatus 100 can deal with, the maximum width in a direction perpendicular to a direction in which the recording paper is carried (a maximum width, in a rotary axis direction, of an abutting area of a fixing roller 1 and the recording paper). Specifically, in the present embodiment, the image forming apparatus 100 is an A4 machine, in which the control section 16 divides the normal-size paper into: A4 short edge feed (a width in the direction perpendicular to the direction in which the recording paper is carried: 210 mm); A5 long edge feed (a width in the direction perpendicular to the direction in which the recording paper is carried: 210 mm); letter size short edge feed (a width in the direction perpendicular to the direction in which the recording paper is carried: 215.9 mm); legal size short edge feed (a width in the direction perpendicular to the direction in which the recording paper is carried: 215.9 mm); invoice size long edge feed (width in the direction perpendicular to the direction in which the recording paper is carried: 215.9 mm); and the like.

In a case where the image forming job is for the normal-size paper ("Yes" in S1), the control section 16 sets a fixing temperature to a first fixing temperature (190° C.) (S2), performs a fixing process (S3), finishes an image forming mode, and then shifts to a standby mode.

On the other hand, in a case where the image forming job is for recording paper other than the normal-size paper, i.e., in a case where the fixing process is to be performed with recording paper which is categorized as having narrower width in the rotary axis direction of the fixing roller than that of the normal-size paper ("No" in S1), the control section 16 sets the fixing temperature to a second fixing temperature (180° C.) that is lower than the first fixing temperature (S4), and then performs the fixing process (S5).

Thereafter, the control section 16 determines whether the number of printings (the number of fixing processes to be performed) indicated by the image forming job is a predetermined threshold number (the threshold number is 50 in the present embodiment) or larger, or is smaller than the predetermined threshold number (S6).

In a case where the number of printings is smaller than the threshold number, the control section 16 finishes the image forming mode, and then shifts to the standby mode.

On the other hand, in a case where the number of printings is the threshold number or larger, the control section 16 shifts to a cooling mode to perform a cooling process of the fixing roller 1 (S7). Specifically, the control section 16 stops supplying power to heater lamps in a fixing device 30, as well as causes the fixing roller 1 to rotate idly for a predetermined cooling period (the cooling period is 30 seconds in the present embodiment) to cool down the fixing roller 1. After the predetermined cooling period has passed, the control section 16 finishes the cooling mode and then shifts to the standby mode.

As described above, in the case where the fixing process is performed for the recording paper smaller than the normal-size paper, the image forming apparatus 100 according to the present embodiment sets the fixing temperature to a temperature lower than that for the normal-size paper.

Because of this, the fixing process for the small-size paper can be performed with (i) a lower temperature of the fixing roller 1 in a paper non-passing region and (ii) a lower temperature of an external heat belt 3 in a paper non-passing region. As a result, a coating material on a surface of the external heat belt 3 becomes rarely scrapable even if a scraper 7 abuts against the external heat belt 3. Accordingly, it is possible to prevent the coating material which was scraped off from adhering to the fixing roller 1, thereby preventing a decrease in releasability of the fixing roller 1 in the region through which the small-size paper does not pass. Therefore, a fixing process for the normal-size paper subsequent to the fixing process for the small-size paper can be performed without suffering from a high-temperature offset in a region corresponding to the region through which the small-size paper does not pass.

In a case where a surface of the external heat belt 3 is coated with a resin material such as fluorocarbon resin, the external heat belt 3 is associated with such a problem that, because the resin material becomes softer as a temperature thereof increases, it becomes easier for the scraper to scrape off the resin material as the temperature of the resin material rises. Therefore, the fixing temperature for the small-size paper is preferably set to a temperature as low as possible, provided that the fixing process can be performed for paper being fed at a predetermined paper-carrying speed and at a predetermined paper-carrying interval without causing the high-temperature offset or a low temperature offset.

Further, in the present embodiment, a process of the cooling mode is performed in a case where the fixing process has been continuously performed for the small-size paper more than a predetermined number of times. The process of the cooling mode reduces a surface temperature of the fixing roller 1. Because of this, the fixing process for the normal-size paper after the fixing process for the small-size paper can be performed with the fixing roller 1 whose temperature in the region through which the small-size paper does not pass is reduced to prevent the high-temperature offset on the normal-size paper in the region corresponding to the region through which the small-size paper does not pass.

A high-temperature offset threshold temperature, which is a highest temperature at which a toner on the surface of the fixing roller 1 does not offset, varies depending on an amount of the coating material adhered to the surface of the fixing roller 1. This is because the high-temperature offset threshold temperature is affected by the releasability of the fixing roller 1. Therefore, the cooling is preferably performed for a period (cooling period), or longer, within which a surface temperature of the fixing roller 1 in the region through which the small-size paper does not pass decreases to a temperature lower than the high-temperature offset threshold temperature of the case where the predetermined amount of the coating material is adhered to the fixing roller. Further, the predetermined amount of the coating material is determined preferably in view of an amount of the coating material to be accumulated on the surface of the fixing roller 1 during usage of the fixing roller 1. For example, the predetermined amount of the coating material may be set to an amount of the coating material assumed to accumulate on the surface of the fixing roller after the fixing process has been performed for a predetermined number of sheets of paper.

In the present embodiment, the cooling period is a period predetermined in advance. However, the cooling period is not necessarily predetermined. The cooling may be performed for a variable period by using temperature detecting means such as a thermistor for monitoring the surface temperature of the fixing roller in the region through which the small-size paper does not pass. In this case, the cooling is performed until the surface temperature of the fixing roller in the region through which the small-size paper does not pass decreases to a predetermined temperature or lower. Further, the cooling may be performed with a cooling period determined depending on the number of sheets of small-size paper which have been continuously subjected to the fixing process. In this case, based on the number of sheets of small-size paper which have been continuously subjected to the fixing process, the cooling period is determined so that the surface temperature of the fixing roller in the region through which the small-size paper does not pass decreases to a temperature lower than the high-temperature offset threshold temperature of the case where the predetermined amount of the coating material is adhered to the surface of the fixing roller 1.

The present embodiment describes an example in which the normal-size paper and the paper smaller than the normal-size paper are used. However, the cooling period may be determined on further divided groups of paper. Similarly, the fixing temperature may be determined depending on the groups.

In the present embodiment, the normal-size paper is divided into the A4 short edge feed, the A5 long edge feed, the letter size short edge feed, the legal size short edge feed, the invoice size long edge feed, and the like. However, how to divide the normal-size paper is not limited to those listed above. For example, the letter size short edge feed, the legal size short edge feed, and the invoice size long edge feed may be categorized as the normal-size paper, whereas the A4 short edge feed and the A5 long edge feed may be categorized as the paper smaller than the normal-size paper.

In the present embodiment, the fixing roller 1 includes only one heater lamp 5*c* inside thereof. However, the number of heater lamps is not limited to one, and a plurality of heater lamps may be provided along a rotary axis direction of the fixing roller 1. For example, a heater lamp for heating a region through which the small-size paper passes and a heater lamp for heating the region through which the small-size paper does not pass may be provided in such a way that the heater lamp for heating the region through which the small-size paper does not pass is supplied with lower power when the fixing process is performed for the small-size paper than when the fixing, process is performed for the normal-size paper. This makes it possible to prevent excessive rise of the temperature of the fixing roller 1 in the region through which the small-size paper does not pass.

In the present embodiment, a configuration in which a scraper 7 and a cleaning pad 12 are provided as cleaning members was explained. However, the configuration of the cleaning members is not limited to the one described above. For example, either the scraper 7 or the cleaning pad 12 may not be provided. Alternatively, either the scraper 7 or the cleaning pad 12 may be substituted by another cleaning member such as a cleaning web.

In the present embodiment, heating rollers 4*a* and 4*b*, a fixing roller 1, and a pressure roller 2 are each provided with a heater lamp. However, a configuration of heater lamps is not limited to the one described above. For example, only each of the heating roller 4*a* and/or the heating roller 4*b* may be provided with the heater lamp. Alternatively, only each of the heating roller 4*a* and/or the heating roller 4*b* and the fixing roller 1 may be provided with the heater lamp.

In the present embodiment, an external heat unit 13 includes an external heat belt 3 as an external heat member which abuts against a fixing member so as to heat the fixing member. However, the external heat member is not limited to the one described above. For example, the external heat member may be a roller.

Finally, the control section 16 of the fixing device 30, particularly a temperature control section 14 and a rotation control section 17, may be each constituted by a hardware logic, and may also be realized with software by using a CPU in a way described below.

That is, the fixing device 30 includes: a CPU (central processing unit) which executes a command from a control program for implementing each function; a ROM (read only memory) on which the control program is stored; a RAM (random access memory) which deploys the control program; and a storage memory such as a memory on which the control program and various data are stored. With this configuration, the object of the present invention is achievable also by (i) supplying, to the fixing device 30, a computer-readable recording medium on which a program code (execute form program, intermediate code program, and source program) of the control program of the fixing device 30 is stored, which program code is a software for implementing the above-described functions, and then (ii) causing the computer (or the CPU or the MPU) to read out and execute the program code.

Examples of the recording medium encompass: tape-type media such as a magnetic tape and a cassette tape; disk-type media which encompass a magnetic disk such as a floppy (registered trademark) disk and a hard disk, and an optical disk such as CD-ROM, MO, MD, DVD, and CD-R; card-type media such as an IC card (which encompasses a memory card) and an optical card; and semiconductor memory-type media such as a mask ROM, EPROM, EEPROM, and flash ROM.

Further, the fixing device 30 may be configured connectably to a communication network, via which the program code may be supplied. The communication network is not limited to a particular kind, and may be for example: the Internet; an intranet; an extranet; LAN; ISDN; VAN; a CATV communication network; a virtual private network; a telephone line network; a mobile communication network; or a satellite communication network. Moreover, a transmission medium constituting the communication network is not limited to a particular kind, and may be for example: a wired transmission such as IEEE1394, a USB, a power-line carrier, a cable TV line, a telephone line, and an ADSL line; or a wireless transmission such as infrared ray such as IrDA and remote control, Bluetooth (registered trademark), 802.11 radio transmission, HDR, a mobile phone network, a satellite line, and a digital terrestrial network. The present invention can be achieved also by the program code in a form of a computer data signal, which is the program code realized by an electronic transmission and is embedded in a signal carrier.

As so far described, in the Specification, the "means" does not necessarily intend to physical means, but also intends to a case where a function of each means is implemented by software. Further, a function of one means may be implemented by two or more physical means, and alternatively, functions of two or more means may be implemented by one physical means.

The invention is not limited to the description of the embodiments above, but may be altered within the scope of the claims. An embodiment based on a proper combination of technical means disclosed in different embodiments is encompassed in the technical scope of the invention.

As so far described, a fixing device of the present invention is a fixing device including: a fixing member which rotates; a pressure member which is pressed against the fixing member;

an external heat member which rotatably abuts against a surface of the fixing member so as to heat the fixing member; heating means for heating the external heat member; a cleaning member which abuts against a surface of the external heat member so as to remove work-ups being adhered to the surface of the external heat member, wherein: a recording medium is fed in between the fixing member and the pressure member, and onto the recording medium, the fixing member thermally fixes a toner image on the recording medium, the fixing device including: a control section for controlling a surface temperature of the fixing member, the control section being configured such that a fixing temperature is set per group into which recording media to be subjected to the fixing process are divided according to their widths in a direction of a rotary axis of the fixing member, the fixing temperature being a surface temperature of the fixing member during a fixing process, and being set in such a way that the fixing temperature is set to a lower temperature for a group of narrower widths.

A control method of the present invention of controlling a fixing device is a control method of controlling a fixing device, the fixing device including: a fixing member which rotates; a pressure member which is pressed against the fixing member; an external heat member which rotatably abuts against a surface of the fixing member so as to heat the fixing member; heating means for heating the external heat member; a cleaning member which abuts against a surface of the external heat member so as to remove work-ups being adhered to the surface of the external heat member, wherein: a recording medium is fed in between the fixing member and the pressure member, and onto the recording medium, the fixing member thermally fixes a toner image on the recording medium, the controlling method comprising: setting a fixing temperature per group into which recording media to be subjected to the fixing process are divided according to their widths in a direction of a rotary axis of the fixing member, the fixing temperature being a surface temperature of the fixing member during a fixing process, and being set in such a way that the fixing temperature is set to a lower temperature for a group of narrower widths.

According to the fixing device and the controlling method, the fixing temperature (the surface temperature of the fixing member during the fixing process) is set per group into which the recording media to be subjected to the fixing process are divided according to their widths in the direction of the rotary axis of the fixing member, in such a way that the fixing temperature is set to the lower temperature for the group of the narrower widths. This makes it possible to prevent an excess heating of the fixing member in a region where the recording medium does not abut, thereby preventing a temperature rise of the external heat member in a region where the above region of the fixing member abuts. Therefore, it is possible to prevent the surface of the external heat member from being heated and becoming easily scrapable. As such, it is possible to reduce an amount of the materials scraped off from the external heat member due to a rubbing contact of the external heat member and the cleaning member, thereby reducing an amount of the materials adhered to the fixing member. As a result, it is possible to prevent a decrease in releasability of the fixing member caused by the materials adhered to the fixing member, and to prevent the high-temperature offset in a region where the materials adhere.

The fixing device may be arranged, in the above arrangement, such that in a case where the fixing process is to be performed for a recording medium having a larger width than or a width equal to a predetermined width after the fixing process was continuously performed for more than a predetermined number of recording media each having a smaller width than the predetermined width, the control section performs a cooling process reducing the surface temperature of the fixing member before the fixing process is performed for the recording medium having the larger width than or the width equal to the predetermined width.

With this arrangement, even in a case where a temperature of the fixing member in a region where the recording medium does not abut has risen due to continuous fixing processes for the recording media each having the smaller width than the predetermined width, it is possible to reduce the surface temperature of the fixing member in this region and thereafter to perform the fixing process for the recording medium having the larger width than or the width equal to the predetermined width. This makes it possible to prevent a temperature rise of the external heat member in a region where the region of the fixing member abuts. As a result, it is possible to prevent a surface of the external heat member from becoming easily scrapable due to heat. Thus, it is possible to reduce an amount of the materials scraped off from the external heat member due to an abutting contact of the external heat member and the cleaning member, thereby reducing an amount of the materials adhered to the fixing member. As such, it is possible to prevent a reduction in releasability of the fixing member due to the materials being adhered to the fixing member, thereby preventing the high-temperature offset in a region where the materials adhere.

A fixing device of the present invention is a fixing device including: a fixing member which rotates; a pressure member which is pressed against the fixing member; an external heat member which rotatably abuts against a surface of the fixing member so as to heat the fixing member; heating means for heating the external heat member; a cleaning member which abuts against a surface of the external heat member so as to remove work-ups being adhered to the surface of the external heat member, wherein: a recording medium is fed in between the fixing member and the pressure member, and onto the recording medium, the fixing member thermally fixes a toner image on the recording medium, the fixing device including: a control section for controlling a surface temperature of the fixing member, the controlling section performing a cooling process in a case where the fixing process is to be performed for a recording medium having a larger width than or a width equal to a predetermined width after the fixing process was continuously performed for more than a predetermined number of recording media each having a smaller width than the predetermined width, the cooling process reducing a surface temperature of the fixing member before the fixing process is performed for the recording medium having the larger width than or the width equal to the predetermined width.

A control method of the present invention of controlling a fixing device is a control method of controlling a fixing device, the fixing device including: a fixing member which rotates; a pressure member which is pressed against the fixing member; an external heat member which rotatably abuts against a surface of the fixing member so as to heat the fixing member; heating means for heating the external heat member; a cleaning member which abuts against a surface of the external heat member so as to remove work-ups being adhered to the surface of the external heat member, wherein: a recording medium is fed in between the fixing member and the pressure member, and onto the recording medium, the fixing member thermally fixes a toner image on the recording medium, the controlling method including: performing a cooling process, in a case where the fixing process is to be performed for a recording medium having a larger width than or a width equal to a predetermined width after the fixing process was continuously performed for more than a predetermined number of recording media each having a smaller width than the predetermined width, the cooling process reducing a surface temperature of the fixing member before the fixing process is performed for the recording medium having the larger width than or the width equal to the predetermined width.

According to the fixing device and the control method for controlling the fixing device, in the case where the fixing process is to be performed for the recording medium having the larger width than or the width equal to the predetermined width after the fixing process was continuously performed for more than the predetermined number of recording media each having the smaller width than the predetermined width, the cooling process for reducing the surface temperature of the fixing member is performed before the fixing process is performed for the recording media having the larger width than or the width equal to the predetermined width. This makes it possible, even in a case where a temperature of the fixing member in a region where the recording medium does not abut has risen due to continuous fixing processes for the recording media each having the smaller width than the predetermined width, to reduce the surface temperature of the fixing member in this region and thereafter to perform the fixing process for the recording medium having the larger width than or the width equal to the predetermined width. This makes it possible to prevent a temperature rise of the external heat member in a region where the region of the fixing member abuts. As a result, it is possible to prevent a surface of the external heat member from becoming easily scrapable due to heat. Thus, it is possible to reduce an amount of the materials scraped off from the external heat member due to the abutting contact of the external heat member and the cleaning member, thereby reducing the amount of the materials being adhered to the fixing member. As such, it is possible to prevent the reduction in releasability of the fixing member due to the materials being adhered to the fixing member, thereby preventing the high-temperature offset in the region where the materials adhere.

Further, the fixing device may be arranged such that the control section performs the cooling process by rotating the fixing member without heating the fixing member.

With this arrangement, it is possible to efficiently cool down the fixing member without providing a special device for the cooling process.

The fixing device may be arranged such in the case where the fixing process is to be performed for the recording medium having the larger width than or the width equal to the predetermined width after the fixing process was continuously performed for more than the predetermined number of recording media each having the smaller width than the predetermined width, the control section performs the cooling process so that the surface temperature of the fixing member in a region where the recording media each having the smaller width than the predetermined width do not abut is reduced to a temperature equal to or lower than a highest temperature at which a high-temperature offset does not occur during the fixing process for the recording medium having the predetermined width even in a case where a material scraped off from the external heat member by the cleaning member is adhered to the region where the recording media each having the smaller width than the predetermined width do not abut. Further, the fixing device may be arranged such that in the case where the fixing process is to be performed for the recording medium having the larger width than or the width equal to the predetermined width after the fixing process was continuously performed for more than the predetermined number of recording media each having the smaller width than the predetermined width, the control section performs the cooling process over a predetermined period that is set so that the surface temperature of the fixing member in the region where the recording media each having the smaller width than the predetermined width do not abut is reduced to the temperature equal to or lower than the highest temperature at which the high-temperature offset does not occur during the fixing process for the recording medium having the predetermined width even in the case where the material scraped off is adhered to the region where the recording media each having the smaller width than the predetermined width do not abut.

With these arrangements, it is possible to reduce, the surface temperature of the fixing member in the region where the recording media each having the smaller width than the predetermined width do not abut, to the temperature equal to or lower than the temperature at which the high-temperature offset does not occur during the fixing process for the recording medium having the predetermined width, even in the case where the material scraped off from the external heat member by the cleaning member is adhered to the region where the recording media each having the smaller width than the predetermined width do not abut. This makes it possible to surely prevent the high-temperature offset.

The fixing device may be arranged such that the external heat member is an endless belt suspended between a plurality of suspension rollers.

The fixing device may be arranged such that a surface of the external heat member, which surface abuts against the fixing member and against the cleaning member, is made of a resin material.

Generally in a case where the surface, which abuts against the cleaning member, of the external heat member is made of the resin material, the resin material is easily scrapable from the external heat member due to the abutting contact of the external heat member and the cleaning member. As a result, the materials scraped off from the external heat member adhere to the fixing member, thereby causing the high-temperature offset. However, with the arrangement described above, it is possible to prevent the high-temperature offset even in the case as described above.

The fixing device may be arranged such that the cleaning member is a scraper which is made of a plate whose edge portion abuts against the surface of the external heat member so as to remove the work-ups being adhered to the surface of the external heat member. Further, the fixing device may be arranged such that the scraper is made of metal.

In these arrangements, the use of the scraper which has an excellent cleaning performance makes it possible to efficiently clean the work-ups on the external heat member. This makes it possible to prevent a deterioration in image quality caused by the work-ups being adhered to the recording medium, which work-ups originally adhered to the external heat member and moved onto the fixing member and then moved onto the recording medium. Generally, the scraper tends to scrape part of the external heat member; however, the arrangements described above makes it possible to reduce an amount of the materials scraped off from the external heat member by the scraper. This prevents the high-temperature offset, which is caused by the materials being adhered to the surface of the fixing member.

The fixing device may be arranged such that the cleaning member is a cleaning pad whose surface abuts against the surface of the external heat member so as to remove the work-ups being adhered to the surface of the external heat member. Further, the fixing device may be arranged such that the cleaning pad is a felt member made of fluorocarbon resin fabric.

In these arrangements, the use of the cleaning pad makes it possible to efficiently clean the work-ups on the external heat material. This makes it possible to prevent deterioration in the image quality due to the work-ups being adhered to the recording medium, which work-ups originally adhered to the external heat member and moved onto the fixing member and then moved onto the recording medium. Furthermore, it is possible to reduce an amount of the materials scraped off from the external heat member by the cleaning pad, thereby preventing the high-temperature offset, which is caused by the materials being adhered to the surface of the fixing member.

Further, the fixing device may be arranged such that the cleaning member is constituted by the scraper and the cleaning pad.

With this arrangement, it is possible to prevent deterioration in image quality caused by the work-ups being adhered to the recording medium, which work-ups originally adhered to the external heat member and moved onto the fixing member and then moved onto the recording medium. Further, it is possible to prevent the high-temperature offset, which is caused by the materials which are scraped off from the external heat member by the cleaning pad and adhered to the surface of the fixing member.

An image forming apparatus of the present invention includes one of the fixing devices so far described. Therefore, it is possible to prevent deterioration in releasability of the fixing member caused by the materials, which are scraped off from the external heat member due to the abutting contact of the external heat member and the cleaning member and then adhered to the fixing member, thereby preventing the high-temperature offset in the region where the materials adhere.

The control section of the fixing device may be constituted by a computer. In this case, the scope of the present invention encompass (i) a control program of the fixing device, which control program causes the computer to function as the control section so that the control section is constituted by the computer and (ii) a computer-readable recording medium on which the control program is stored.

The embodiments discussed in the foregoing description of embodiments and concrete examples serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

Industrial Applicability

The present invention is applicable to a fixing device for use in an image forming apparatus employing an electrophotographic printing method.

Reference Signs List

| | |
|---|---|
| 1 | Fixing Roller (Fixing Member) |
| 2 | Pressure Roller (Pressure Member) |
| 3 | External Heat Belt (External Heat Member, Endless Belt) |
| 4a to 4b | Heat Rollers (Suspension Rollers) |
| 5a to 5d | Heater Lamps (Heating Sections) |
| 6a to 6c | Thermistors |
| 7 | Scraper (Cleaning Member) |
| 7a | Cleaning Section |
| 7b | Holding Part |

-continued

Reference Signs List

| | |
|---|---|
| 7c | Slit |
| 9 | Recording Paper (Recording Material) |
| 11 | External Heat Unit Holder |
| 12 | Cleaning Pad (Cleaning Member) |
| 12a | Felt Member (Cleaning Member) |
| 12b | Felt Holding Part |
| 13 | External Heat Unit |
| 14 | Temperature Control Section (Control Section) |
| 15 | Power Supply Circuit |
| 16 | Control Section |
| 17 | Rotation Control Section (Control Section) |
| 18 | Rotation Drive Section |
| 30 | Fixing Device |
| 100 | Image Forming Apparatus |

The invention claimed is:

1. A fixing device comprising:

a fixing member which rotates;

a pressure member which is pressed against the fixing member;

an external heat unit including an external heat member which rotatably abuts against a surface of the fixing member so as to heat the fixing member;

heating means for heating the external heat member;

a cleaning member which abuts against a surface of the external heat member on which the fixing member is abutted, the cleaning member being abutted on a position moved from a position where the fixing member is abutted to a position where the fixing member is not abutted, the position being moved due to rotation of the external heat member, so as to remove work-ups being adhered to the surface of the external heat member, wherein:

the cleaning member is a fixed member fixed to a housing of the external heat unit, so that a part of the cleaning member abutting against the external heat member does not relatively move with respect to the housing, a recording medium is fed in between the fixing member and the pressure member, and onto the recording medium, the fixing member thermally fixes a toner image on the recording medium, the fixing device comprising:

a control section for controlling a surface temperature of the fixing member, the controlling section performing a cooling process in a case where the fixing process is to be performed for a recording medium having a larger width than or a width equal to a predetermined width after the fixing process was continuously performed for more than a predetermined number of recording media each having a smaller width than the predetermined width, the cooling process reducing a surface temperature of the fixing member before the fixing process is performed for the recording medium having the larger width than or the width equal to the predetermined width, so that the surface temperature of the fixing member in a region where the recording media each having the smaller width than the predetermined width do not abut is reduced to a temperature equal to or lower than a highest temperature at which a high-temperature offset does not occur during the fixing process for the recording medium having the predetermined width even in a case where a material scraped off from the external heat member by the cleaning member is adhered to the region where the recording media each having the smaller width than the predetermined width do not abut.

2. The fixing device according to claim 1, wherein the external heat member is an endless belt suspended between a plurality of suspension rollers.

3. The fixing device according to claim 1, wherein the control section performs the cooling process by rotating the fixing member without heating the fixing member.

4. The fixing device according to claim 1, wherein in the case where the fixing process is to be performed for the recording media having the larger width than or the width equal to the predetermined width after the fixing process was continuously performed for more than the predetermined number of recording media each having the smaller width than the predetermined width, the control section performs the cooling process over a predetermined period that is set so that the surface temperature of the fixing member in the region where the recording media each having the smaller width than the predetermined width do not abut is reduced to the temperature equal to or lower than the highest temperature at which the high-temperature offset does not occur during the fixing process for the recording medium having the predetermined width even in the case where the material scraped off is adhered to the region where the recording media each having the smaller width than the predetermined width do not abut.

5. The fixing device according to claim 1, wherein a surface of the external heat member, which surface abuts against the fixing member and against the cleaning member, is made of a resin material.

6. The fixing device according to claim 1, wherein the cleaning member is a scraper which is made of a plate whose edge portion abuts against the surface of the external heat member so as to remove the work-ups being adhered to the surface of the external heat member.

7. The fixing device according to claim 6, wherein the scraper is made of metal.

8. The fixing device according to claim 1, wherein the cleaning member is a cleaning pad whose surface abuts against the surface of the external heat member so as to remove the work-ups being adhered to the surface of the external heat member.

9. The fixing device according to claim 8, wherein the cleaning pad is a felt member made of fluorocarbon resin fabric.

10. The fixing device according to claim 1, wherein the cleaning member is constituted by (i) a scraper which is made of a plate whose edge portion abuts against the surface of the external heat member so as to remove the work-ups being adhered to the surface of the external heat member and (ii) a cleaning pad whose surface abuts against the surface of the external heat member so as to remove the work-ups being adhered to the surface of the external heat member.

11. An image forming apparatus comprising a fixing device as set forth in claim 1.

12. A non-transitory computer-readable recording medium on which a control program, which causes a fixing device as set forth in claim 1 to operate and causes a computer to function as the control section, is stored.

13. A controlling method of controlling a fixing device, the fixing device including:

a fixing member which rotates;

a pressure member which is pressed against the fixing member;

an external heat unit including an external heat member which rotatably abuts against a surface of the fixing member so as to heat the fixing member;

heating means for heating the external heat member;

a cleaning member which abuts against a surface of the external heat member on which the fixing member is abutted, the cleaning member being abutted on a position moved from a position where the fixing member is abutted to a position where the fixing member is not abutted, the position being moved due to rotation of the external heat member, so as to remove work-ups being adhered to the surface of the external heat member, wherein:

the cleaning member is a fixed member fixed to a housing of the external heat unit, so that a part of the cleaning member abutting against the external heat member does not relatively move with respect to the housing, a recording medium is fed in between the fixing member and the pressure member, and onto the recording medium, the fixing member thermally fixes a toner image on the recording medium, the controlling method comprising:

performing a cooling process, in a case where the fixing process is to be performed for a recording medium having a larger width than or a width equal to a predetermined width after the fixing process was continuously performed for more than a predetermined number of recording media each having a smaller width than the predetermined width, the cooling process reducing a surface temperature of the fixing member before the fixing process is performed for the recording medium having the larger width than or the width equal to the predetermined width, so that the surface temperature of the fixing member in a region where the recording media each having the smaller width than the predetermined width do not abut is reduced to a temperature equal to or lower than a highest temperature at which a high-temperature offset does not occur during the fixing process for the recording medium having the predetermined width even in a case where a material scraped off from the external heat member by the cleaning member is adhered to the region where the recording media each having the smaller width than the predetermined width do not abut.

* * * * *